US005705465A

United States Patent [19]

Angevaare et al.

[11] Patent Number: 5,705,465

[45] Date of Patent: Jan. 6, 1998

[54] ANTI-FOAM SYSTEM FOR AUTOMATIC DISHWASHING COMPOSITIONS

[75] Inventors: Petrus Adrianus Angevaare, Ho-Ho-Kus; Alla Tartakovsky, West Orange, both of N.J.

[73] Assignee: Lever Brothers Company, Division of Conopco, Inc., New York, N.Y.

[21] Appl. No.: 539,923

[22] Filed: Oct. 6, 1995

[51] Int. Cl.[6] ..... C11D 3/386; C11D 3/395; C11D 1/66

[52] U.S. Cl. ..... 510/220; 510/220; 510/228; 510/324; 510/484; 510/375; 510/379; 510/380; 510/495; 134/42

[58] Field of Search ..... 510/220, 226, 510/228, 374, 375, 379, 380, 484, 495; 134/42

[56] References Cited

U.S. PATENT DOCUMENTS

| | | | |
|---|---|---|---|
| 2,954,347 | 9/1960 | Fekete et al. | 510/355 |
| 2,954,357 | 9/1960 | Fekete et al. | 260/29.1 |
| 3,941,710 | 3/1976 | Gilbert et al. | 252/99 |
| 4,087,398 | 5/1978 | Heyden et al. | 260/29.6 R |
| 4,620,936 | 11/1986 | Kielman et al. | 252/99 |
| 4,937,011 | 6/1990 | Schmid et al. | 252/99 |
| 5,173,207 | 12/1992 | Drapier et al. | 252/99 |
| 5,200,236 | 4/1993 | Lang et al. | 427/213 |
| 5,268,119 | 12/1993 | Simpson et al. | 252/95 |
| 5,423,997 | 6/1995 | Angevaare | 252/99 |
| 5,510,048 | 4/1996 | Durbut et al. | 252/95 |

FOREIGN PATENT DOCUMENTS

| | | |
|---|---|---|
| 0517314 | 12/1992 | European Pat. Off. . |
| 517 314 | 12/1992 | European Pat. Off. . |
| 0554943 | 8/1993 | European Pat. Off. . |
| 554 943 | 8/1993 | European Pat. Off. . |

*Primary Examiner*—Paul Lieberman
*Assistant Examiner*—Kery A. Fries
*Attorney, Agent, or Firm*—A. Kate Huffman

[57] ABSTRACT

An automatic dishwashing detergent composition is described which comprises 0.01 to 1.0% of a fatty acid having from 12 to 22, preferably from 16 to 18, carbon atoms in the acyl radical and are preferably unsaturated; 0.1 to 2% of a carrier containing a ketone which has at least 25 carbon atoms; 0.5 to 40% of a surfactant; 0.1 to 10 weight % of a proteolytic enzyme; 1 to 30 weight % of a bleaching agent selected from the group of a peroxygen or hypohalite agent; and 1 to 75% of a builder providing a composition having a pH of less than about 11. Specifically, the detergent composition must have a weight ratio of long-chain ketone/carrier to fatty acid of 5:1 to 1:1, preferably from 4:1 to 2:1. A method of using the composition is also described.

16 Claims, 1 Drawing Sheet

ANTI-FOAM SYSTEM FOR AUTOMATIC DISHWASHING COMPOSITIONS

FIELD OF THE INVENTION

This invention relates to an anti-foam system based on the combination of a fatty acid and a long-chain ketone for incorporation in an automatic dishwashing detergent composition to provide improved cleaning and low foaming performance.

BACKGROUND OF THE INVENTION

Detergent compositions for automatic dishwashers have become increasingly milder and less alkaline than earlier prior art products. Such compositions have a safer and more environmentally friendly profile because the compositions are formulated without chlorine bleach and are free of phosphates. To avoid compromising cleaning performance, however, enzymes are increasingly included in the formulations to remove proteinaceous and starchy soils.

It has been observed that proteolytic enzymes combined with selected surfactants and incorporated in liquid machine dishwashing compositions provide a synergistic improvement in the removal of proteinaceous soil. See, e.g. EP 554 943 (Unilever) published on Aug. 11, 1993. Although such systems exhibit improved cleaning, the presence of the surfactant generates foam in the machine. Since foam can cause air to be drawn into the water circulating pump of the dishwashing machine, it reduces the mechanical impact of the detergent solution sprayed onto the dishware. As a result, foaming ultimately compromises cleaning performance.

Prior art automatic dishwashing compositions generally contain low levels (generally from 1 to 2%) of a nonionic surfactant to control foaming caused by food residues. These nonionic surfactants have cloud points below the operating temperature of the dishwasher and they therefore form hydrophobic droplets in the wash which exert an anti-foam action. However, this anti-foam technology is not appropriate in compositions containing also other surfactants, as the formation of the foam inhibiting cloud phase can be retarded by the presence of these other surfactants.

Another category of anti-foam agents for automatic dishwashing compositions are known in the art as long-chain ketones described in U.S. Pat. No. 4,937,011 (Henkel) and U.S. Pat. No. 4,087,398 (Henkel). Although the long-chain ketones are effective in inhibiting foam resulting from food residues in dishwashing machines, the compositions in which these ketones are used do not contain a surfactant. Additionally, the long-chain ketones work effectively at the beginning of the washing cycle, but the carrier in which the ketone particles reside is believed to break down to form small, ineffective droplets as the cycle continues so that anti-foam performance drops in the latter portion of the washing cycle.

Fatty acids and soaps have also been suggested as anti-foam agents such as described in U.S. Pat. No. 2,954,347 (Procter & Gamble) and EP 554 943 (Unilever). The effectiveness of a fatty acid anti-foam agent such as potassium oleate, depends on the production of a calcium salt in the wash liquor in the dishwashing machine. The formation of effective calcium soap anti-foam particles is not instantaneous at the start of the wash cycle so that the anti-foam effectiveness is only present toward the end of the washing cycle. Additionally, if soft water is used in the dishwasher or if the dishwasher is equipped with a softener unit for hard water areas the availability of calcium is limited so that higher amounts of fatty acid actually increase foaming in such automatic dishwashers.

Applicants have discovered that the use of a dual anti-foam system, that is, selected long-chain ketone/carrier systems and certain fatty acids provide a synergistic improvement over the use of the individual components and provide an effective anti-foam system.

The combination of a fatty acid with an anti-foam agent was described in EP 517 314 (Colgate Palmolive Company). However, long-chain ketones as an effective anti-foam in the possible combination was not mentioned.

In DE 14 67 613 long-chain ketones were described as foam inhibitors in soap containing detergents for fabric washing. Fabric washing machines are much more tolerant of foaming than dishwashers, primarily because of the much lower agitation compared to that caused by the spray-arms in the automatic dishwashers and lower amounts of proteinaceous soils. Therefore, the compositions taught in the German publication included high foaming surfactants which would not be tolerated in an automatic dishwashing machine.

It is thus an object of the present invention to provide a dual anti-foam system including a carrier containing a long-chain ketone and a fatty acid in a ratio of about 5:1 to 1:1, preferably from 4:1 to 2:1, which may be incorporated into an automatic dishwashing composition.

Another object of the invention is to provide compositions for a dishwasher which comprise enzymes with selected surfactants and which have a pH of less than about 11 to provide a highly effective cleaning composition which performs consistently throughout the dishwashing cycle.

More particularly, ketones having at least 25 carbon atoms are combined with selected fatty acids to provide an effective anti-foam system for use in surfactant containing low alkalinity dishwashing compositions.

A method of washing tableware in an automatic dishwashing machine with a low alkalinity detergent composition which provides effective cleaning without foam formation is also described.

SUMMARY OF THE INVENTION

An automatic dishwashing detergent composition is described which comprises:

a) an anti-foam system comprising of 0.01 to 1 wt. % of the total dishwashing composition of a fatty acid and salts thereof having from 12 to 22 carbon atoms and 0.1 to 2 wt. % of the total dishwashing composition of a carrier containing a ketone having at least 25 carbon atoms, the ratio of ketone/carrier to fatty acid being from 5:1 to 1:1; preferably from 4:1 to 2:1;

b) 0.5 to 40 wt. % of a surfactant selected from the group consisting of:

(i) anionic surfactants with a hydrophilic head group which is, or which contains a sulfate or sulfonate group and a hydrophobic portion which is or which contains an alkyl or alkenyl group of 6 to 24 carbon atoms;

(ii) alkyl glycosides;

(iii) ethoxylated fatty alcohols of formula:

$$RO(CH_2CH_2O)_nM$$

where R is an alkyl group of 6 to 16 carbon atoms and n has an average value which is at least four and is sufficiently high that the HLB of the ethoxylated fatty alcohol is 10.5 or greater;

c) 0.1 to 10 wt. % of a proteolytic enzyme;

d) 1 to 30 wt. % of a bleaching agent selected from a group of a peroxygen agent, a hypohalite agent and its corresponding salts and its mixtures thereof; and e) 1 to 75 wt. % of a builder, wherein a 1% aqueous solution of the detergent composition has a pH of less than about 11.

A method of washing tableware in a dishwasher providing effective cleaning without foam formation is also described.

DETAILED DESCRIPTION OF THE PREFERRED EMBODIMENTS

Figure 1:
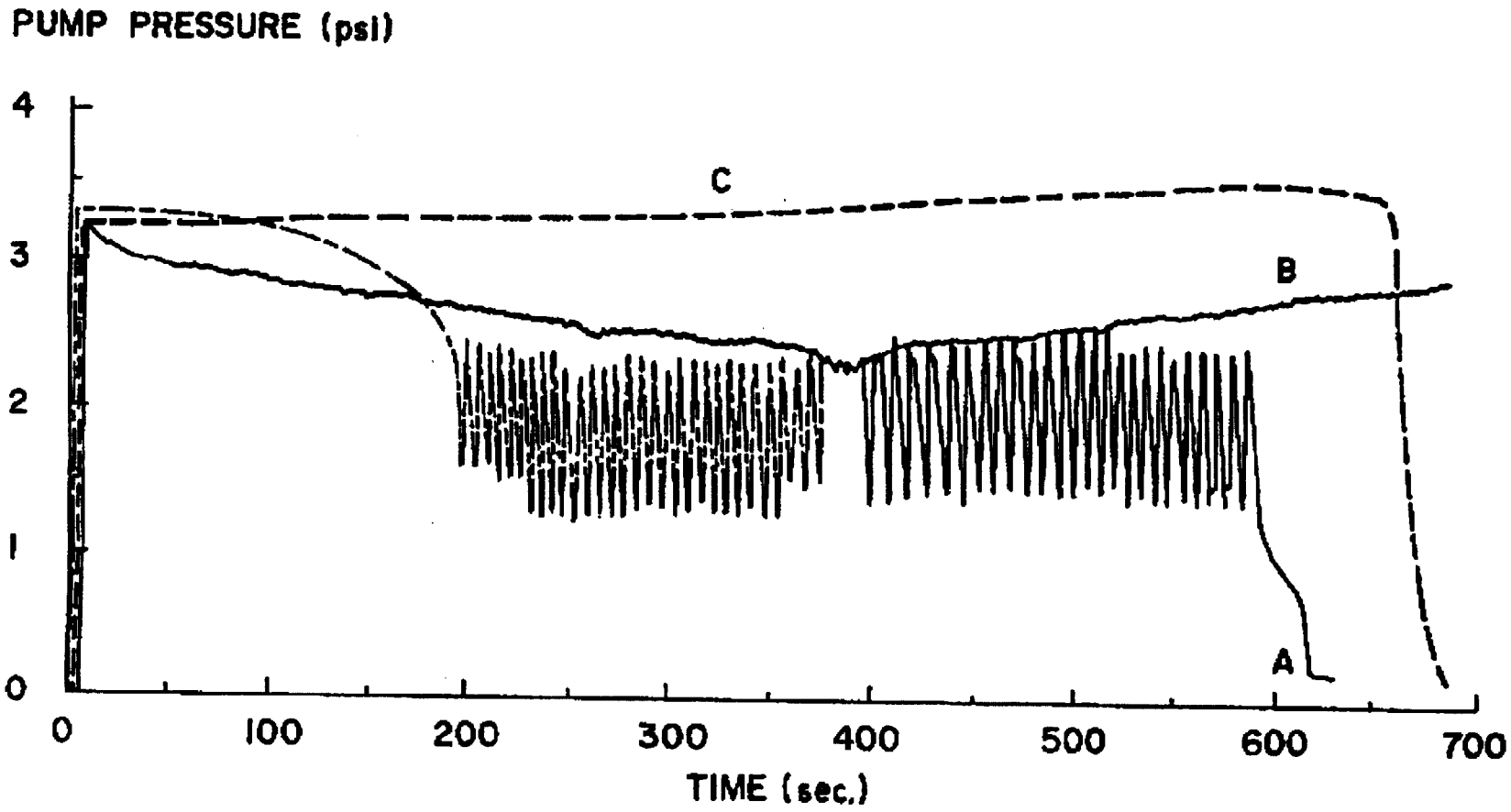
FIG. 1 is a diagramtic representation of pump pressures which were supported throughout a main wash for the inventive antifoam mixture as compared to prior art materials as described in Example 3.

Compositions of the invention may be in any form conventional in the art such as liquid, gel, powder or tablet. The compositions are also produced by any conventional means known in the art.

Anti-foam System

The anti-foam system of the invention comprises a long-chain ketone and a selected fatty acid in a ratio of 5:1 to 1:1, preferably from 4:1 to 2:1, ketone to fatty acid.

The long-chain ketones are prepared as described in U.S. Pat. No. 4,937,011 (Henkel), herein incorporated by reference. The ketones are prepared by catalytic elimination of $CO_2$ from higher monocarboxylic acids, more particularly relatively high molecular weight fatty acids or salts thereof.

Preferred ketones are those obtained by the reaction of linear or branched, saturated or unsaturated carboxylic acids or carboxylic acid mixtures in which the carboxylic acids or some of them contain more than 12 carbon atoms and in particular, have a carbon chain-length of $C_{14}$ to $C_{30}$ and, on ketonization, react with water with elimination of carbon dioxide. Particularly preferred ketones are those obtained by the ketonization of $C_{16}$–$C_{22}$carboxylic acids or carboxylic acid salts and mixtures thereof as described in U.S. Pat. No. 4,937,011 (Henkel).

Mixtures of symmetrical and asymmetrical ketones are formed in which the asymmetrical ketones, commensurate with the material used, may have chain lengths other than $C_{14}$ or $C_{12}$ provided that a relatively long-chain radical is present in the molecule so that the total number of carbon atoms on average is at least about 25. Examples are heptacosanone-14, hentriacontanone-16, pentatriacontanone-18, nonatriacontanone-20, triatetracontanone-22 or nonacossanone-15, tritriacontanone-17, heptatriacontanone-19, hentetracontanone-21 and the like.

Ketones or ketone mixtures useful in the present invention are normally solid at room temperature and have melting points in the range from 60° to 105° C. To make them easier to process and to improve their foam-inhibiting effect, it is preferred to disperse the ketones in a liquid carrier. In addition to water, suitable liquid phases are preferably organic carriers which have a low pour point or melting point of lower than about 5° C. It is also preferable to use free-flowing carriers or carrier mixtures which have a comparatively high viscosity and contribute stabilization of the dispersions. The liquid carrier phase may also have a foam-inhibiting effect or may be used solely as a carrier for the foam inhibitor of the invention.

Particularly useful organic carrier liquids, which have an additional foam-inhibiting effect, are mineral oils having a boiling point above 140° C. and branched alcohols containing 8 to 24 carbon atoms, such as 2-hexyl-1-decanol or 2-octyl-2-dodecanol. Other useful foam-inhibiting carrier liquids are liquid esters of branched or unsaturated fatty acids containing 8 to 18 carbon atoms with monohydric or polyhydric alcohols, for example glycol diesters or glycerol triesters of oleic acid, isostearic acid; esters based on branched-chain or unsaturated, liquid fatty alcohols containing 8 to 18 carbon atoms, for example isotridecyl alcohol or oleyl alcohol. Mixtures of these carriers may also be used.

It is preferred to use organic carriers in which the ketones are soluble at elevated temperature and precipitate in finely divided form on cooling. To this end, the components are heated, a solution formed and then rapidly cooled with intensive stirring. Stable dispersions of finely divided foam inhibitors are formed. However, dispersions may also be prepared by stirring the finely ground, wax-like ketone or ketone mixture into the liquid phase.

The dispersions to be processed preferably contain from about 5 to about 15% by weight of the ketone or mixtures of ketones. The carrier/ketone combination is present in the detergent composition in an amount of from 0.1 to 2 wt. %.

In addition, the dispersion of the ketone in the liquid carrier may be stabilized by suitable additives. Suitable additives are, for example, magnesium stearate, calcium stearate or aluminum stearate in quantities of from about 0.3 to 3.0% by weight.

Commercially available ketones of the type described above are available under the Dehypon® Series from Henkel Kommanditgesellschaft auf Aktien, Germany.

The fatty acids, or their alkali metal, preferably potassium, salts selected to combine with the ketones of the invention should have from 12 to 22, preferably from 16 to 18, carbon atoms in the acyl radical and are preferably unsaturated. A mixture of fatty acids may also be used. Preferred fatty acids include palmitic acid, palmitoleic acid, oleic acid, stearic acid and linoleic acid.

Without being bound by theory, it is postulated that the selected fatty acid or its alkali metal salt combines with the calcium salt of the water of the wash liquor to form the calcium soap of the fatty acid which is the effective anti-foam component.

The fatty acid is present in the composition in an amount of from 0.01 to 1.0%.

Surfactants

Useful surfactants include anionic, nonionic, cationic, amphoteric, zwitterionic types and mixtures of these surface active agents. Such surfactants are well known in the detergent art and are described at length in "Surface Active Agents and Detergents", Vol. II, by Schwartz, Perry & Birch, Interscience Publishers, Inc. 1959, herein incorporated by reference.

Preferred surfactants are one or a mixture of:

Anionic surfactants

Anionic synthetic detergents can be broadly described as surface active compounds with one or more negatively charged functional groups. An important class of anionic compounds are the water-soluble salts, particularly the alkali metal salts, of organic sulfur reaction products having in their molecular structure an alkyl radical containing from about 6 to 24 carbon atoms and a radical selected from the group consisting of sulfonic and sulfuric acid ester radicals.

Primary Alkyl Sulfates $$R^1OSO_3M$$

where $R^1$ is a primary alkyl group of 8 to 18 carbon atoms and M is a solubilizing cation. The alkyl group $R^1$ may have a mixture of chain lengths. It is preferred that at least two thirds of the $R^1$ alkyl groups have a chain length of 8 to 14 carbon atoms. This will be the case if $R^1$ is coconut alkyl, for example. The solubilizing cation may be a range of cations which are in general monovalent and confer water solubility. Alkali metal, notably sodium, is especially envisaged. Other possibilities are ammonium and substituted ammonium, such as trialkanolammonium.

Alkyl Ether Sulfates $$R^1O(CH_2CH_2O)_nSO_3M$$

where $R^1$ is a primary alkyl group of 8 to 18 carbon atoms, n has an average value in the range from 1 to 6 and M is a solubilizing cation. The alkyl group $R^1$ may have a mixture of chain lengths. It is preferred that at least two thirds of the $R^1$ alkyl groups have a chain length of 8 to 14 carbon atoms. This will be the case if $R^1$ is coconut alkyl, for example. Preferably n has an average value of 2 to 5.

Fatty Acid Ester Sulfonates $$R^2CH(SO_3M)CO_2R^3$$

where $R^2$ is an alkyl group of 6 to 16 atoms, $R^3$ is an alkyl group of 1 to 4 carbon atoms and M is a solubilizing cation. The group $R^2$ may have a mixture of chain lengths. Preferably at least two thirds of these groups have 6 to 12 carbon atoms. This will be the case when the moiety $R^2CH(—)CO_2(—)$ is derived from a coconut source, for instance. It is preferred that $R^3$ is a straight chain alkyl, notably methyl or ethyl.

Alkyl Benzene Sulfonates $$R^4ArSO_3M$$

where $R^4$ is an alkyl group of 8 to 18 carbon atoms, Ar is a benzene ring ($C_6H_4$) and M is a solubilizing cation. The group $R^4$ may be a mixture of chain lengths. Straight chains of 11 to 14 carbon atoms are preferred.

Particularly preferred anionic surfactants are the fatty acid ester sulfonates with formula:

$$R^2CH(SO_3M)CO_2R^3$$

where the moiety $R^2CH(—)CO_2(—)$ is derived from a coconut source and $R^3$ is either methyl or ethyl.

Nonionic surfactants

Nonionic surfactants can be broadly defined as surface active compounds with one or more uncharged hydrophilic substituents.

Alkali Glycosides $$R^5O(R^6O)_n(Z^1)_p$$

wherein $R^5$ is a monovalent organic radical (e.g., a monovalent saturated aliphatic, unsaturated aliphatic or aromatic radical such as alkyl, hydroxyalkyl, alkenyl, hydroxyalkenyl, aryl, alkylaryl, hydroxyalkylaryl, arylalkyl, alkenylaryl, arylalkenyl, etc.) containing from about 6 to about 30 (preferably from about 8 to 18 and more preferably from about 9 to about 13) carbon atoms; $R^6$ is a divalent hydrocarbon radical containing from 2 to about 4 carbon atoms such as ethylene, propylene or butylene (most preferably the unit $(R^6O)_n$ represents repeating units of ethylene oxide, propylene oxide and/or random or block combinations thereof); n is a number having an average value of from 0 to about 12; $Z^1$ represents a moiety derived from a reducing saccharide containing 5 or 6 carbon atoms (most preferably a glucose unit); and p is a number having an average value of from 0.5 to about 10 preferably from about 0.5 to about 5.

Examples of commercially available materials from Henkel Kommanditgesellschaft Aktien of Dusseldorf, Germany include APG® 300, 325 and 350 with $R^4$ being $C_9$–$C_{11}$, n is 0 and p is 1.3, 1.6 and 1.8–2.2 respectively; APG® 500 and 550 with $R^4$ is $C_{12}$–$C_{13}$, n is 0 and p is 1.3 and 1.8–2.2, respectively; and APG® 600 with $R^4$ being $C_{12}$–$C_{14}$, n is 0 and p is 1.3.

While esters of glucose are contemplated especially, it is envisaged that corresponding materials based on other reducing sugars, such as galactose and mannose are also suitable.

Ethoxylated Fatty Alcohols

Ethoxylated fatty alcohols may be used alone or in admixture with anionic surfactants, especially the preferred surfactants above. However, if it is used alone than the fatty alcohol must be of limited chain length so that average chain lengths of the alkyl group R in the general formula:

$$RO(CH_2CH_2O)_nH$$

is from 6 to 12 carbon atoms. This is preferred in any event, and especially preferred if the weight of anionic surfactant is less than half the weight of ethoxylated fatty alcohol. Notably the group R may have chain lengths in a range from 9 to 11 carbon atoms.

An ethoxylated fatty alcohol normally is a mixture of molecules with different numbers of ethylene oxide residues. Their average number, n, together with the alkyl chain length, determines wether the ethoxylated fatty alcohol has a hydrophobic character (low HLB value) or a hydrophilic character (high HLB value). Preferably, the HLB value should be 10.5 or greater. This requires the average value of n to be at least 4, and possibly higher. The numbers of ethylene oxide residues may be a statistical distribution around the average value. However, as is known, the distribution can be affected by the manufacturing process or altered by fractionation after ethoxylation. Particularly preferred ethoxylated fatty alcohols have a group R which has 9 to 11 carbon atoms while n is from 5 to 8.

Most preferred surfactants are the fatty acid ester sulfonates with formula:

$$R^2CH(SO_3M)CO_2R^3$$

where the moiety $R^2CH(—)CO_2(—)$ is derived from a coconut source and $R^3$ is either methyl or ethyl.

The amount of glycoside surfactant, anionic surfactant and/or ethoxylated fatty alcohol surfactant will be from 0.5 to 40% by weight of the composition. Desirably the total amount of surfactant lies in the same range. The preferred range of surfactant is from 0.5 to 30% by weight, more preferably from 0.5 to 15% by weight.

Enzymes

Proteases capable of facilitating the removal of proteinaceous soils from a substrate are also present in the invention in an amount of from 0.1 to 10 weight percent, preferably 1 to about 5 weight percent. Such proteases include Alcalase®, Relase®, Savinase® and Esperase® from Novo Industries A/S, Maxacale® from Gist-Brocades/IBIS, and Opticlean from MKC.

The compositions may also contain amylases (e.g., Termamyl® from Novo Industries A/S) and lipases (e.g. Lipolase® from Novo Industries A/S).

Bleaching Agents

A wide variety of halogen and peroxygen bleach sources may be used in the present invention. Examples of such halogen and peroxygen bleaches are described in U.S. Pat. No. 5,200,236 issued to Lang et al., herein incorporated by reference.

Among suitable reactive chlorine or bromine oxidizing materials are heterocyclic N-bromo and N-chloro imides such as trichloroisocyanuric, tribromoisocyanuric, dibromoisocyanuric and dichloroisocyanuric acids, and salts thereof with water-solubizing cations such as potassium and sodium. Hydantoin compounds such as 1,3-dichloro-5,5-dimethylhydantoin are also quite suitable.

Dry, particular, water-soluble anhydrous inorganic salts are like wise suitable for use herein such as lithium, sodium or calcium hypochlorite and hypobromite. Chlorinated trisodium phosphate is another core material. Chloroisocyanurates are, however, the preferred halogen bleaching agents. Potassium dichloroisooyanurate is said by Monsanto Company as ACL-59®. Sodium dichloroisocyanurates are also available from Monsanto as ACL-60®, and in the dihydrate form, from the Olin Corporation as Clearon CDB-56®, available in powder form (particle diameter of less than 150 microns); medium particle size (about 50 to 400 microns); and coarse particle size (150–850 microns). Very large particles (850–1700 microns) are also found to be suitable for encapsulation.

The oxygen bleaching agents of the compositions also include organic peroxy acids and diacylperoxides. Typical monoperoxy acids useful herein include alkyl peroxy acids and aryl peroxy acids such as:

(i) peroxybenzoic acid and ring-substituted peroxybenzoic acids, e.g., peroxy-alpha-naphthoic acid, and magnesium monoperphthalate (ii) aliphatic and substituted aliphatic monoperoxy acids, e.g., peroxylauric acid, peroxystearic acid, epsilon-phthalimido peroxyhexanoic acid and o-carboxybenzamido peroxyhexanoic acid, N-nonenylamidoperadipic acid and N-nonenylamidopersuccinic acid.

Typical diperoxy acids useful herein include alkyl diperoxy acids and aryldiperoxy acids, such as:

(iii) 1,12-diperoxydodecanedioic acid (iv) 1,9-diperoxyazelaic acid (v) diperoxybrassylic acid; diperoxysebacic acid and diperoxy-isophthalic acid (vi) 2-decyldiperoxybutane-1,4-dioic acid (vii) N,N'-terephthaloyl-di(6-aminopercaproic acid).

A typical diacylperoxide useful herein includes dibenzoylperoxide.

Inorganic peroxygen compounds are also suitable for the present invention. Examples of these materials useful in the invention are salts of monopersulfate, perborate monohydrate, perborate tetrahydrate, and percarbonate.

Preferred oxygen bleaching agents include epsilon-phthalimido-peroxyhexanoic acid, o-carboxybenzamidoperoxyhexanoic acid, and mixtures thereof.

The oxygen bleaching agent is present in the composition in an amount of from about 1 to 20 weight percent, preferably 1 to 15 weight percent, most preferably 2 to 10 weight percent.

The oxygen bleaching agent may be incorporated directly into the formulation or may be encapsulated by any number of encapsulation techniques known in the art to produce stable capsules in alkaline liquid formulations.

A preferred encapsulation method is described in U.S. Pat. No. 5,200,236 issued to Lang et al., herein incorporated by reference. In the patented method, the bleaching agent is encapsulated as a core in a paraffin wax material having a melting point from about 40° C. to about 50° C. The wax coating has a thickness of from 100 to 1500 microns.

Bleach Precursors

Suitable peroxygen peracid precursors for peroxy bleach compounds have been amply described in the literature, including GB Nos. 836,988; 855,735; 907,356; 907,358; 907,950; 1,003,310 and 1,246,339; U.S. Pat. Nos. 3,332,882 and 4,128,494.

Typical examples of precursors are polyacylated alkylene diamines, such as N,N,N',N'-tetraacetylethylene diamine (TAED) and N,N,N',N'-tetraacetylmethylene diamine (TAMD); acylated glycolurils, such as tetraacetylglycoluril (TAGU); triacetylcyanurate, sodium sulphophyl ethyl carbonic acid ester, sodium acetyloxybenzene sulfonate (SABS), sodium nonanoyloxy benzene sulfonate (SNOBS) and choline sulfophenyl carbonate. Peroxybenzoic acid precursors are known in the art, e.g., as described in GB-A-836,988. Examples of suitable precursors are phenylbenzoate; phenyl p-nitrobenzoate; o-nitrophenyl benzoate; o-carboxyphenyl benzoate; p-bromophenylbenzoate; sodium or potassium benzoyloxy benzene-sulfonate; and benzoic anhydride.

Preferred peroxygen bleach precursors are sodium p-benzoyloxybenzene sulfonate, N,N,N',N'-tetraacetylethylene diamine, sodium nonanoyloxybenzene sulfonate and choline sulfophenyl carbonate.

Detergent Builder Materials

The compositions of this invention can contain all manner of detergent builders commonly taught for use in automatic dishwashing or other cleaning compositions. The builders can include any of the conventional inorganic and organic water-soluble builder salts, or mixtures thereof and may comprise 1 to 75%, and preferably, from about 5 to about 70% by weight of the cleaning composition.

Typical examples of phosphorus-containing inorganic builders, when present, include the water-soluble salts, especially alkali metal pyrophosphates, orthophosphates and polyphosphates. Specific examples of inorganic phosphate builders include sodium and potassium tripolyphosphates, phosphates, pyrophosphates and hexametaphosphates.

Suitable examples of non-phosphorus-containing inorganic builders, when present, include water-soluble alkali metal carbonates, bicarbonates, sesquicarbonates, borates, silicates, metasilicates, and crystalline and amorphous aluminosilicates. Specific examples include sodium carbonate (with or without calcite seeds), potassium carbonate, sodium and potassium bicarbonates, silicates and zeolites.

Particularly preferred inorganic builders can be selected from the group consisting of sodium tripolyphosphate, potassium tripolyphosphate, potassium pyrophosphate, sodium carbonate, potassium carbonate, sodium bicarbonate, sodium silicate and mixtures thereof. When present in these compositions, sodium tripolyphosphate concentrations will range from about 2% to about 40%; preferably from about 5% to about 30%. Potassium tripolyphosphate concentrations will range from about 2% to about 50%, preferably from about 5% to about 40%. Sodium carbonate and bicarbonate when present can range from about 5% to about 50%; preferably from about 10% to about 30% by weight of the cleaning compositions. Sodium tripolyphosphate and potassium pyrophosphate can be used as builders in gel formulations, where they may be present from about 3 to about 30%, preferably from about 10 to about 20%.

Organic detergent builders can also be used in the present invention. Examples of organic builders include alkali metal citrates, succinates, malonates, fatty acid sulfonates, fatty acid carboxylates, nitrilotriacetates, phytates, phosphonates, alkanehydroxyphosphonates, oxydisuccinates, alkyl and alkenyl disuccinates, oxydiacetates, carboxymethyloxy succinates, ethylenediamine tetraacetates, tartrate monosuccinates, tartrate disuccinates, tartrate monoacetates, tartrate diacetates, oxidized starches, oxidized heteropolymeric polysaccharides, polyhydroxysulfonates, polycarboxylates such as polyacrylates, polymaleates, polyacetates, polyhydroxyacrylates, polyacrylate/polymaleate and polyacrylate/polymethacrylate copolymers, acrylate/maleate/vinyl alcohol terpolymers, aminopolycarboxylates and polyacetal carboxylates. Such carboxylates are described in U.S. Pat. Nos. 4,144,226 and 4,146,495.

Alkali metal citrates, oxydisuccinates, polyphosphonates and acrylate/maleate copolymers and acrylate/maleate/vinyl alcohol terpolymers are especially preferred organic builders. When present they are preferably available from about 1% to about 35% of the total weight of the detergent compositions.

The foregoing detergent builders are meant to illustrate but not limit the types of builders that can be employed in the present invention.

Alkalinity

The alkalinity of an aqueous solution for the composition of the invention less than a pH of about 11, preferably 5 to 10, most preferably 7 to 9. Buffering agent materials should be present in the invention in an amount of from about 1 to about 30 weight %, preferably from 5 to about 25 weight % of the total composition. Any number of conventional buffer agents may be used to maintain the desired pH range. Such materials can include, for example, various water soluble inorganic salts such as carbonates, bicarbonates, sesquicarbonates, silicates, phosphates, tetraborates and mixtures thereof.

If silicates are present in the compositions of the invention, the preferred amounts are from about 1 to about 20%. Especially preferred is sodium silicate in a ratio of $SiO_2$:$Na_2O$ up from about 1.0 to about 3.3, preferably from about 2 to about 3.2. Insoluble silica such as described in Tomlinson, Atty. Docket No. 94-0222, C7362, herein incorporated by reference may be incorporated as a decor care ingredient and glass anticorrosion agent.

Filler

An inert particulate filler material which is water-soluble may also be present in cleaning compositions. This material should not precipitate calcium or magnesium ions at the filler use level. Suitable for this purpose are organic or inorganic compounds. Organic fillers include sucrose esters and urea. Representative inorganic fillers include sodium sulfate, sodium chloride and potassium chloride. A preferred filler is sodium sulfate. Its concentration may range from 0% to 60%, preferably from about 10% to about 30% by weight of the cleaning composition.

Thickeners and Stabilizers

Thickeners are often desirable for liquid cleaning compositions. Thixotropic thickeners such as smectite clays including montmorillonite (bentonite), hectorite, saponite, and the like may be used to impart viscosity to liquid cleaning compositions. Silica, silica gel, and aluminosilicate may also be used as thickeners. Salts of polyacrylic acid (of molecular weight of from about 300,000 up to 6 million and higher), including polymers which are cross-linked may also be used alone or in combination with other thickeners. Use of clay thickeners for automatic dishwashing compositions is disclosed for example in U.S. Pat. Nos. 4,431,559; 4,511,487; 4,740,327; 4,752,409. Commercially available synthetic smectite clays include Laponite supplied by Laporte Industries. Commercially available bentonite clays include Korthix H and VWH ex Combustion Engineering, Inc.; Polargel T ex American Colloid Co.; and Gelwhite clays (particularly Gelwhite GP and H) ex English China Clay Co. Polargel T is preferred as imparting a more intense white appearance to the composition than other clays. The amount of clay thickener employed in the compositions is from 0.1 to about 10%, preferably 0.5 to 5%. Use of salts of polymeric carboxylic acids is disclosed for example in UK Patent Application GB 2,164,350A, U.S. Pat. No. 4,859,358 and U.S. Pat. No. 4,836,948.

For liquid formulations with a "gel" appearance and rheology, particularly if a clear gel is desired, a chlorine-resistant polymeric thickener is particularly useful. U.S. Pat. No. 4,260,528 discloses natural gums and resins for use in clear autodish detergents, which are not chlorine stable. Acrylic acid polymers that are cross-linked manufactured by, for example, B. F. Goodrich and sold under the trade name "Carbopol" have been found to be effective for production of clear gels, and Carbopol 940, 617 and 627, having a molecular weight of about 4,000,000 is particularly preferred for maintaining high viscosity with excellent chlorine stability over extended periods. Further suitable chlorine-resistant polymeric thickeners are described in U.S. Pat. No. 4,867,896 incorporated by reference herein.

The amount of thickener employed in the compositions is from 0 to 5%, preferably 0.5–3%.

Stabilizers and/or co-structurants such as long chain calcium and sodium soaps and $C_{12}$ to $C_{18}$ sulfates are detailed in U.S. Pat. Nos. 3,956,158 and 4,271,030 and the use of other metal salts of long chain soaps is detailed in U.S. Pat. No. 4,752,409. Other co-structurants include Laponite and metal oxides and their salts as described in U.S. Pat. No. 4,933,101, herein incorporated by reference. The amount of stabilizer which may be used in the liquid cleaning compositions is from about 0.01 to about 5% by weight of the composition, preferably 0.01–2%. Such stabilizers are optional in gel formulations. Co-structurants which are found especially suitable for gels include trivalent metal ions at 0.01–4% of the compositions, Laponite and/or water-soluble structuring chelants at 1–60%. These co-structurants are more fully described in the U.S. Pat. No. 5,141,664 by Corring et al., hereby incorporated by reference.

The following examples will serve to distinguish this invention from the prior art and illustrate its embodiments more fully. Unless otherwise indicated, all parts, percentages and proportions referred to are by weights.

EXAMPLE 1

The foam behavior of surfactants in the automatic dishwasher was investigated by monitoring the pressure of the water circulating pump during the mainwash stage of a dishwash cycle. All experiments were carried out in a 5 liter Bosch SMS 6082 automatic dishwashing machine that had been adapted to allow pump pressure monitoring. The rapid program of the dishwasher, consisting of a mainwash (heated to 50° C.), two cold rinses, a final rinse (heated to 65° C.) and a drying step, was used for these experiments. To allow pressure monitoring, a pressure transducer (ex. Omega Engineering Inc., Conn.) was installed in the dishwasher, more specifically, close to the circulating pump in the water hose leading to the lower spray-arm.

Table 1 shows the base dishwashing composition used for this example.

TABLE 1

| Ingredient | % By weight |
|---|---|
| Sodium citrate (as .2$H_2O$) | 51 |
| Sokalan CP5[1] | 5 |
| Sokalan PA25[2] | 2.5 |
| Sodium bicarbonate | 39 |
| Silicate 2.8[3] | 2.5 |

[1]An acrylic acid/maleic acid copolymer supplied by BASF Corporation, New Jersey
[2]A polyacrylic acid, sodium salt supplied by BASF Corporation, New Jersey
[3]Supplied by The PQ Corporation, Pennsylvania.

Foam generation by a surfactant, either anionic or nonionic, when added on top of 16.5 g of this base composition was determined by monitoring the pump pressure. Soft water (water hardness<10 ppm) was used. The pump pressures are shown in Table 2. These pressures are calculated averages, as measured during the mainwash, and are expressed as a percentage of the average pressure obtained in the absence of a surfactant.

TABLE 2

| Surfactant | pump pressure (%) |
|---|---|
| None | 100 |
| 0.08 mM Stepanol[4] | 95 |
| 0.1 mM Stepanol | 77 |
| 0.12 mM Stepanol | 65 |
| 0.14 mM Stepanol | 55 |
| 0.1 mM APG[5] | 100 |
| 0.2 mM APG | 80 |
| 0.3 mM APG | 50 |
| 0.1 mM Alphastep[6] | 100 |
| 0.25 mM Alphastep | 78 |
| 0.5 mM Alphastep | 56 |

[4]Stepanol WA-Extra, a primary alkyl sulfate supplied by Stepan Chemicals, Illinois.
[5]APG 325CS, an alkyl polyglycoside supplied by Henkel Corporation, Pennsylvania.
[6]Alphastep ML40, a fatty acid ester sulfonate supplied by Stepan Chemicals, Illinois.

Table 2 shows that even low surfactant levels can cause a significant pump pressure drop. Without being limited to theory, it is believed that this pump pressure drop is caused by air drawn into the pump of the automatic dishwasher as a result of foam formation.

Again without being limited to theory, foam is thought to reduce the mechanical impact of the wash liquor onto the dishware, thereby compromising on cleaning performance. Furthermore, foam can interfere with the supply of water to the heating element of the dishwasher, which could eventually wreck the heating element. Excessive foam formation can also lead to air locking of the water circulating pump, eventually destroying the pump.

Table 2 also shows the benefit of the fatty acid ester sulfonate Alphastep ML40, being a low-foaming anionic surfactant. Since the average pump pressure as a function of concentration does not drop as steeply as with both other surfactants shown in Table 2, higher concentrations of the fatty acid ester sulfonate can be tolerated in the dishwashing machine.

Table 3 shows the effect of anionic surfactant concentration on the removal of soil from glass slides. New glass slides (50×50×1 mm) were machine washed and repeatedly rinsed with deionized water and subsequently soiled with about 200 mg baked-on egg-yolk per slide. The base composition for these soil removal experiments consisted of 2.04 g sodium citrate (as 0.2$H_2O$), 0.34 g Sokalan CP7 (as 40% solution), 0.20 g sodium tetraborate, and 0.40 g glycerol. These ingredients were added to 1 liter 250 ppm hardness (Ca:Mg=4:1) water and stirred at 55° C. for 10 minutes, after which the pH was adjusted to 8 using $H_2SO_4$ and NaOH. The solutions then received 109 kGU Alcalase 2.5L (Novo Nordisk, Denmark) and an anionic surfactant according to the levels shown in Table 3. The solutions were maintained at 55° C. After one minute, the soiled glass slides were placed in the solution. The slides were removed after 30 minutes, dried and weighed to determine soil removal. The quantity removed was expressed as a percentage of the original soil.

Results were as follows:

TABLE 3

| Surfactant | w % egg-yolk removal |
|---|---|
| none | 11 |
| 0.25 mM Stepanol | 35 |
| 0.5 mM Stepanol | 52 |
| 1.0 mM Stepanol | 54 |
| 1.5 mM Stepanol | 55 |
| 0.25 mM Alphastep | 27 |
| 0.5 mM Alphastep | 42 |
| 1.0 mM Alphastep | 51 |
| 1.5 mM Alphastep | 62 |
| 2.0 mM Alphastep | 65 |

Combining Tables 2 and 3 of this example teaches that optimum soil removal benefits from anionic surfactants are obtained at surfactant concentrations that are too high to be applied without a foam controlling agent. A significant consideration while formulating an automatic dishwashing composition containing a relatively high surfactant level is therefore to suppress foaming.

EXAMPLE 2

This example demonstrates the anti-foam action of Dehypon 2429, a commercially available anti-foam containing 5–15% of the long-chain ketone type in a fatty alcohol carrier. The effect of its level on the average pump pressure was determined using 34 g of the base dishwashing composition shown in Table 4. Water with hardness 250 ppm (Ca:Mg=4:1) was used.

TABLE 4

| Ingredient | % by weight |
|---|---|
| Sodium citrate (as .2$H_2O$) | 30 |
| Sokalan CP7[7] (as 40% solution) | 5 |
| Cross-linked acrylic polymer[8] | 1.5 |
| Glycerol | 6 |
| Sodium tetraborate | 3 |
| Alphastep | 6.6 |
| Water | to balance |

[7]An acrylic acid/maleic acid copolymer supplied by BASF Corporation, New Jersey
[8]A high molecular weight polymer having a molecular weight of about one million, supplied as Carbopol 627 by B. F. Goodrich, Ohio.

The procedure to determine pump pressure was similar to Example 1. The pump pressures are shown in Table 5.

TABLE 5

| Dehypon[9] concentration (ppm) | Average Pump Pressure (%) |
|---|---|
| 10 | 51 |
| 25 | 62 |
| 50 | 69 |
| 100 | 76 |
| 200 | 83 |

[9]Dehypon 2429, a long-chain ketone in a fatty alcohol carrier suplied by Henkel, Germany. This material contains 5–15% long-chain ketones.

The data shown in Table 5 indicates that the pump pressure losses are significant, even with systems containing a Dehypon concentration as high as 200 ppm in the mainwash. Since these experiments were conducted under soil-free conditions and since especially proteinaceous soils are known to cause additional foaming, the efficacy of this single anti-foam was considered to be inadequate. Therefore, improvement of the anti-foam performance was sought by using a combination of different anti-foam systems.

EXAMPLE 3

The synergistic effect of the combination of the long-chain ketone and selected fatty acid of the invention is demonstrated in this example.

Experiments were carried out in a 5 liter Bosch SMS 6082 automatic dishwashing machine that had been adapted to allow pump pressure monitoring. The dishwasher was run on the rapid program, consisting of a mainwash (heated to 50° C.), two cold rinses, a final rinse (heated to 65° C.) and a drying step. Water of 250 ppm hardness (Ca:Mg=4:1) was used for these experiments, no soils were present in the dishwasher. The procedure to determine pump pressure was similar to Example 1.

An anti-foam mixture delivering 50 ppm Dehypon long-chain ketone and 15 ppm potassium oleate in the mainwash was added to 36 g of the following automatic dishwashing composition:

TABLE 6

| Ingredient | % by weight |
|---|---|
| Sodium citrate (as .2$H_2O$) | 28.3 |
| Sokalan CP7 (as 40% solution) | 4.7 |
| Cross-linked acrylic polymer[10] | 0.9 |
| Glycerol | 5.7 |
| Sodium tetraborate | 2.8 |

TABLE 6-continued

| Ingredient | % by weight |
|---|---|
| Alphastep | 6.6 |
| PAP capsules[11] | 5.3 |
| Alcalase 2.5L[12] | 0.8 |
| Termamyl 300L[13] | 0.4 |
| Water | to balance |

[10]Supplied as Carbopol 627 by B. F. Goodrich, Ohio.
[11]Epsilon-phtalimidoperoxyhexanoic acid supplied by Ausimont, Italy, and encapsulated according to U.S. Pat. No. 5,200,236 issued to Lang et al. The resulting capsules are 50% epsilon-phtalimidoperoxyhexanoic acid and 50% wax coating.
[12]Protease supplied by Novo Nordisk, Denmark.
[13]Amylase supplied by Novo Nordisk, Denmark.

The pH of the liquid composition was 8.6.

As Control A, Dehypon 2429 ketone was added to the composition of Table 6, in an amount needed to deliver a concentration of 50 ppm in the mainwash. Similarly, as Control B, potassium oleate was dosed into the composition to deliver a concentration of 15 ppm in the mainwash. Sample C was the anti-foam mixture added to the composition of Table 6.

Pump pressures for Samples A, B and C were recorded in a main wash and illustrated in FIG. 1. The corresponding average pump pressures are shown in Table 7 below:

TABLE 7

| Anti-foam system | Average Pump Pressure (%) |
|---|---|
| Control A - Dehypon 2429 | 65 |
| Control B - K Oleate | 82 |
| Sample C - Anti-foam Mixture | 99 |

It was thus observed that the average pump pressure was unacceptably low when the long chain ketone containing composition (Control A) was used. The low average is caused primarily by pronounced pressure fluctuations at the latter portion of the mainwash. These fluctuations are indicative of high foam levels. Without being limited to theory, the deactivation of this anti-foam is thought to be caused by a break down of the carrier in which the ketone particles reside, leading to the formation of small ineffective droplets as the cycle continues. The composition with potassium oleate (Control B) exhibited a better anti-foaming performance. But again, pressure fluctuations occurred, altough at an earlier stage in the mainwash. The stabilized and increased pressures at the end of the mainwash indicate that some time is needed to form the active calcium oleate particles in the wash. The composition containing the inventive anti-foam system maintained pump pressures of almost 100%, showing also a very stable profile throughout the wash.

The same set of experiments was also performed in a different dishwasher, a 5 liter Electrolux ESF 691 dishwasher, similarly equipped with a pressure transducer. The dishwasher was run on the quick program, consisting of a mainwash (heated to 55° C.), two cold rinses, a final rinse (heated to 65° C.) and a drying step. The average pump pressures shown in Table 8 indicate the same synergistic trend between the long-chain ketone and the fatty acid.

TABLE 8

| Anti-foam system | Average Pump Pressure (%) |
|---|---|
| Control A - Dehypon 2429 | 68 |
| Control B - K Oleate | 48 |
| Sample C - Anti-foam Mixture | 89 |

EXAMPLE 4

This example demonstrates the effect of increasing the fatty acid amount of the anti-foam mixture on the average pump pressure, both under hard and soft water conditions.

The procedure to determine pump pressure was similar to Example 1. The rapid program of the Bosch SMS 6082 dishwasher was used for these experiments. As indicated in Table 9, either soft water (<10 ppm) or water of 250 ppm hardness (Ca:Mg=4:1 ) was used for these experiments, no soils were present in the dishwasher.

Compositions were prepared as described in Example 3 except an amount of Dehypon 2429 was used to deliver a concentration of 50 ppm in the mainwash and the amounts of potassium oleate were varied.

TABLE 9

| Potassium Oleate concentration in the wash (ppm) | Water Hardness (ppm) | Average Pump Pressure (%) |
|---|---|---|
| 0 | 250 | 65 |
| 5 | 250 | 71 |
| 10 | 250 | 83 |
| 15 | 250 | 99 |
| 20 | 250 | 91 |
| 25 | 250 | 91 |
| 15 | <10 | 99 |
| 25 | <10 | 57 |

As the fatty acid amounts were increased in the anti-foam mixture from a ratio of 5:1 to 2:1, ketone to potassium oleate, the production of foam decreased and average pump pressures were greater than 80%. The most preferred ratio is about 3:1, at which a pressure of close to 100% is maintained. At shorter ratios, the anti-foam performance starts to fall off, especially under soft water conditions, which is thought to be caused by the presence of larger amounts of foam generating free fatty acid throughout the wash. Therefore, some water soluble calcium salt may deliberately be included in the composition, thereby ensuring the presence of sufficient levels of calcium to precipitate all fatty acid in the form of its calcium soap.

What is claimed:

1. An automatic dishwashing composition which substantially inhibits foam production in a dishwasher comprising:

a) an anti-foam system comprising of 0.01 to 1.0 wt. % of the total dishwashing composition (i) a fatty acid and salts thereof having from 16 to 18 carbon atoms, and (ii) 0.1 to 2% of the total dishwashing composition by wt. of a carrier containing a ketone which has at least 25 carbon atoms, the ratio of the carrier containing the ketone to fatty acid being from 5:1 to 1:1, b) 0.5 to 40 wt. % of a surfactant selected from the group consisting of (i) an anionic surfactant with a hydrophilic head group which is, or which contains a sulfate or sulfonate group and a hydrophobic portion which is or which contains an alkyl or alkenyl group of 6 to 24 carbon atoms, (ii) an alkyl glycosides, (iii) an ethoxylated fatty alcohol of formula $$RO(CH_2CH_2O)_nM$$

wherein R is an alkyl group of 6 to 16 carbon atoms and n has an average value which is at least four and such that the HLB of the ethoxylated fatty alcohol is 10.5 or greater;

c) 0.1 to 10 wt. % of a proteolytic enzyme, d) 1 to 30 wt. % of a bleaching agent selected from a group of a peroxygen agent, a hypohalite agent and its corresponding salts and mixtures thereof; and e) 1 to 75 wt. % of a builder, wherein a 1% aqueous solution of the detergent composition has a pH of less than about 11.

2. A composition according to claim 2 wherein the fatty acid of the anti-foam system is unsaturated.

3. A composition according to claim 1 wherein the ketone is obtained by the ketonization of $C_{16}$–$C_{22}$ carboxylic acids, carboxylic acid salts and mixtures thereof.

4. A composition according to claim 3 wherein the ketone is selected from the group consisting of heptacosanone-14, hentriacontanone-16, pentatriacontanone-18, nonatriacontanone-20, triatetracontanone-22 or nonacossanone-15, tri-triacontanone-17, heptatriacontanone-19, hentetracontanone-21 and mixtures thereof.

5. A composition according to claim 1 wherein the ratio of the carrier containing the ketone to fatty acid is from 4:1 to 2:1.

6. A composition according to claim 1 wherein the proteolytic enzyme is present in an amount of from 0.3 to 5 wt. %.

7. A composition according to claim 1 wherein the anionic surfactant is selected from the group consisting of i) a primary alkyl sulfates having a formula $$R^1OSO_3M$$

wherein $R^1$ is a primary alkyl group of 8 to 18 carbon atoms and M is a solubilizing cation, ii) an alkyl ether sulfate having a formula $$R^1O(CH_2CH_2O)_nSO_3M$$

wherein $R^1$ is a primary alkyl group of 8 to 18 carbon atoms, n has an average value in the range from 1 to 6 and M is a solubilizing cation, iii) a fatty acid ester sulfonate having a formula $$R^2CH(SO_3M)CO_2R^3$$

wherein $R^2$ is an alkyl group of 6 to 16 atoms, $R^3$ is an alkyl group of 1 to 4 carbon atoms and M is a solubilizing cation, iv) an alkyl benzene sulfonate having a formula $$R^4ArSO_3M$$

wherein $R^4$ is an alkyl group of 8 to 18 carbon atoms, Ar is a benzene ring ($C_6H_4$) and M is a solubilizing cation.

8. A composition according to claim 1 wherein the anionic surfactant is a fatty acid ester sulfonate of formula $$R^2CH(SO_3M)CO_2R^3$$

wherein the moiety $R^2CH(—)C02(—)$ is derived from a coconut source and $R^2$ is an alkyl group of 6 to 26 atoms and $R^3$ is either methyl or ethyl.

9. A composition according to claim 1 wherein the alkyl glycoside is of formula $$R^5O(R^6O)_n(Z^1)_p$$

wherein $R^5$ is a monovalent organic radical containing from about 6 to about 30 carbon atoms; $R^6$ is a divalent hydrocarbon radical containing from 2 to about 4 carbon atoms; n is a number having an average value of from 0 to about 12; $Z^1$ represents a moiety derived from a reducing saccharide containing 5 or 6 carbon atoms; and p is a number having an average value of from 0.5 to about 10.

10. A composition according to claim 9 wherein group $R^5$ contains from about 8 to 18 carbon atoms.

11. A composition according to claim 9 wherein group $R^5$ contains from about 9 to 13 carbon atoms.

12. A composition according to claim 9 wherein p has an average value of from 0.5 to about 5.

13. A method of washing tableware in an automatic dishwashing machine comprising:

contacting soiled tableware with a detergent composition comprising a) an anti-foam system comprising (i) 0.01 to 1.0 wt. % of the total dishwashing composition of a fatty acid and salts thereof having from 16 to 18 carbon atoms, and (ii) 0.1 to 2% by wt. of the total dishwashing composition of a carrier containing a ketone having at least 25 carbon atoms, the ratio of ketone/carrier to fatty acid being from 5:1 to 1:1, b) 0.5 to 40 wt. % of a surfactant selected from the group consisting of (i) an anionic surfactant with a hydrophilic head group which is, or which contains a sulfate or sulfonate group and a hydrophobic portion which is or which contains an alkyl or alkenyl group of 6 to 24 carbon atoms, (ii) an alkyl glycosides, (iii) an ethoxylated fatty alcohol of formula $$RO(CH_2CH_2O)_nM$$

wherein R is an alkyl group of 6 to 16 carbon atoms and n has an average value which is at least four such that the HLB of the ethoxylated fatty alcohol is 10.5 or greater, and mixtures thereof, c) 0.1 to 10 wt. % of a proteolytic enzyme, d) 1 to 30 wt. % of a bleaching agent selected from a group of a peroxygen agent, a hypohalite agent and its corresponding salts and its mixtures thereof, and e) 1 to 75 wt. % of a builder, to substantially clean the tableware and to substantially inhibit foam formation.

14. A method according to claim 13 wherein the fatty acid of the anti-foam system is unsaturated.

15. A method according to claim 13 wherein the ketone is obtained by the ketonization of $C_{16}$–$C_{22}$ carboxylic acids, carboxylic acid salts and mixtures thereof.

16. A method according to claim 15 wherein the ketone is selected from the group consisting of heptacosanone-14, hentriacontanone-16, pentatriacontanone-18, nonatriacontanone-20, triatetracontanone-22 or nonacossanone-15, tri-triacontanone-17, heptatriacontanone-19, hentetracontanone-21 and mixtures thereof.

* * * * *